US011317719B2

(12) United States Patent
Currie

(10) Patent No.: US 11,317,719 B2
(45) Date of Patent: May 3, 2022

(54) CHAIR POSITIONING SYSTEM TO CONTROL RELATIVE POSITIONING OF A CUSTOMER CHAIR WITH AN INTEGRATED STYLIST CHAIR

(71) Applicant: Ester N. Currie, Raleigh, NC (US)

(72) Inventor: Ester N. Currie, Raleigh, NC (US)

( * ) Notice: Subject to any disclaimer, the term of this patent is extended or adjusted under 35 U.S.C. 154(b) by 15 days.

(21) Appl. No.: 16/115,529

(22) Filed: Aug. 28, 2018

(65) Prior Publication Data

US 2020/0069060 A1 Mar. 5, 2020

(51) Int. Cl.

| | |
|---|---|
| ***A47C 1/06*** | (2006.01) |
| ***A47C 1/08*** | (2006.01) |
| *A47C 1/04* | (2006.01) |
| *A47C 1/11* | (2006.01) |

(52) U.S. Cl.

CPC ..... *A47C 1/08* (2013.01); *A47C 1/06* (2013.01); *A47C 1/04* (2013.01); *A47C 1/11* (2013.01)

(58) Field of Classification Search

CPC .... A47C 1/06; A47C 1/04; A47C 1/08; A47C 1/11

See application file for complete search history.

(56) References Cited

U.S. PATENT DOCUMENTS 1,773,504 A * 8/1930 Stokes ..... A47C 1/08 297/242
2,440,644 A * 4/1948 Powell ..... A47C 1/08 297/242
2,539,811 A * 1/1951 Butz ..... A47C 1/06 248/240
2,542,653 A * 2/1951 Frydenlund ..... A47C 1/08 297/242
2,546,460 A * 3/1951 Leeds ..... A47C 1/06 248/122.1
2,557,232 A * 6/1951 Morgan ..... A47C 1/06 297/241
2,578,373 A * 12/1951 Powell ..... A47C 1/06 297/242
2,678,086 A * 5/1954 Mohr ..... A47C 1/06 297/240
2,711,784 A * 6/1955 Kuschel ..... A47C 1/08 297/242
3,044,828 A * 7/1962 Fowler ..... A47C 1/11 297/188.06
3,223,449 A * 12/1965 Naylor ..... A47C 1/08 297/423.14
3,712,669 A * 1/1973 Cates ..... A47C 1/04 297/188.21

(Continued)

*Primary Examiner* — Syed A Islam
(74) *Attorney, Agent, or Firm* — Ester Nevada Currie

(57) ABSTRACT

A base configured to attach to a floor to support the chair system. A rigid trunk member is configured to vertically stabilize by the base, the trunk member adjustable up and down to change a height of the customer chair. The customer chair rotatably connects to and supported by the trunk member. A rigid branch member is configured to rotatably connect to the trunk member for support. The stylist chair is rotatably connected to and supported by the branch member providing a circular range of motion for the stylist chair around and independent of the customer chair. A foot control connects directly or indirectly to the rigid trunk member and positions the customer chair relative to the stylist chair.

10 Claims, 4 Drawing Sheets

(56) References Cited

U.S. PATENT DOCUMENTS

| | | | | | |
|---|---|---|---|---|---|
| 4,572,573 | A * | 2/1986 | Yoshikawa | A47C 1/06 | 297/330 |
| 4,863,217 | A * | 9/1989 | Fountain | A47C 1/08 | 297/241 |
| 5,190,349 | A * | 3/1993 | Austin, Jr. | A61G 15/02 | 297/316 |
| 5,484,188 | A * | 1/1996 | Stoeckl | A61G 15/02 | 297/217.3 |
| 5,529,374 | A * | 6/1996 | Wimberly, Jr. | A47C 1/08 | 297/195.12 |
| 5,884,350 | A * | 3/1999 | Kurze | A61G 15/02 | 297/330 |
| 6,851,748 | B1 * | 2/2005 | Garrick | A47C 1/03 | 248/429 |
| 7,802,851 | B2 * | 9/2010 | Hyvarinen | A61G 15/125 | 297/408 |
| 7,914,076 | B2 * | 3/2011 | Broering | A61G 15/02 | 297/310 |
| 9,993,079 | B1 * | 6/2018 | Scott | A47C 1/11 | |
| 10,123,622 | B1 * | 11/2018 | Hall | A47C 1/08 | |
| 2007/0216205 | A1 * | 9/2007 | Davis | A47C 1/08 | 297/241 |
| 2008/0136236 | A1 * | 6/2008 | Kincaid | A47D 9/02 | 297/260.2 |
| 2019/0200764 | A1 * | 7/2019 | Perales Bot A | A47C 1/08 | |

* cited by examiner

CHAIR POSITIONING SYSTEM TO CONTROL RELATIVE POSITIONING OF A CUSTOMER CHAIR WITH AN INTEGRATED STYLIST CHAIR

FIELD OF THE INVENTION

The invention relates generally to a mechanical apparatus, and more specifically, to a customer chair system to control relative positioning of a customer chair with an integrated stylist chair.

BACKGROUND

Customer chairs, for cosmetology or barber services are conventionally stand-alone devices for the customer receiving a haircut. A stylist working on the customer typically stands or uses a stand-alone stool.

However, the constant readjustments of both the customer chair and the stand-alone stool can be inconvenient and hamper the stylist workflow.

What is needed is an integrated stylist and customer chair system for relative positioning of a stylist and customer.

SUMMARY

To address the above-mentioned shortcomings, an integrated stylist and customer chair system, and methods of positioning a stylist relative to a customer.

In accordance with some embodiments, a base configured to attach to a floor to support the chair system. A rigid trunk member is configured to vertically stabilize by the base, the trunk member adjustable up and down to change a height of the customer chair. The customer chair rotatably connects to and supported by the trunk member.

In one embodiment, a rigid branch member is configured to rotatably connect to the trunk member for support. The stylist chair is rotatably connected to and supported by the branch member providing a circular range of motion for the stylist chair around and independent of the customer chair. A controller configured to connect directly or indirectly to the rigid trunk member and configured to position the customer chair relative to the stylist chair.

Other aspects and features will be evident from reading the following detailed description of the preferred embodiments, which are intended to illustrate, not limit, the invention.

Advantageously, a stylist can easily and more comfortably position themselves during services.

BRIEF DESCRIPTION OF THE FIGURES

In the following figures, like reference numbers are used to refer to like elements. Although the following figures depict various examples of the invention, the invention is not limited to the examples depicted in the figures.

FIG. 3 is a high-level block diagram illustrating a method for positioning a stylist chair relative to a customer chair in an integrated stylist and customer chair system for, according to one embodiment.

DETAILED DESCRIPTION

The present invention provides systems for an integrated stylist and customer chair system, and methods of positioning a stylist relative to a customer. One of ordinary skill in the art will recognize that many other scenarios are possible given the disclosure herein. For example, the chair system can be configured not only for hair styling by a barber, but makeup application, aesthetician, and dental services, as well, without limitation.

I. Stylist Chair Positioning Control System (FIGS. 1-2)

Figure 1A:
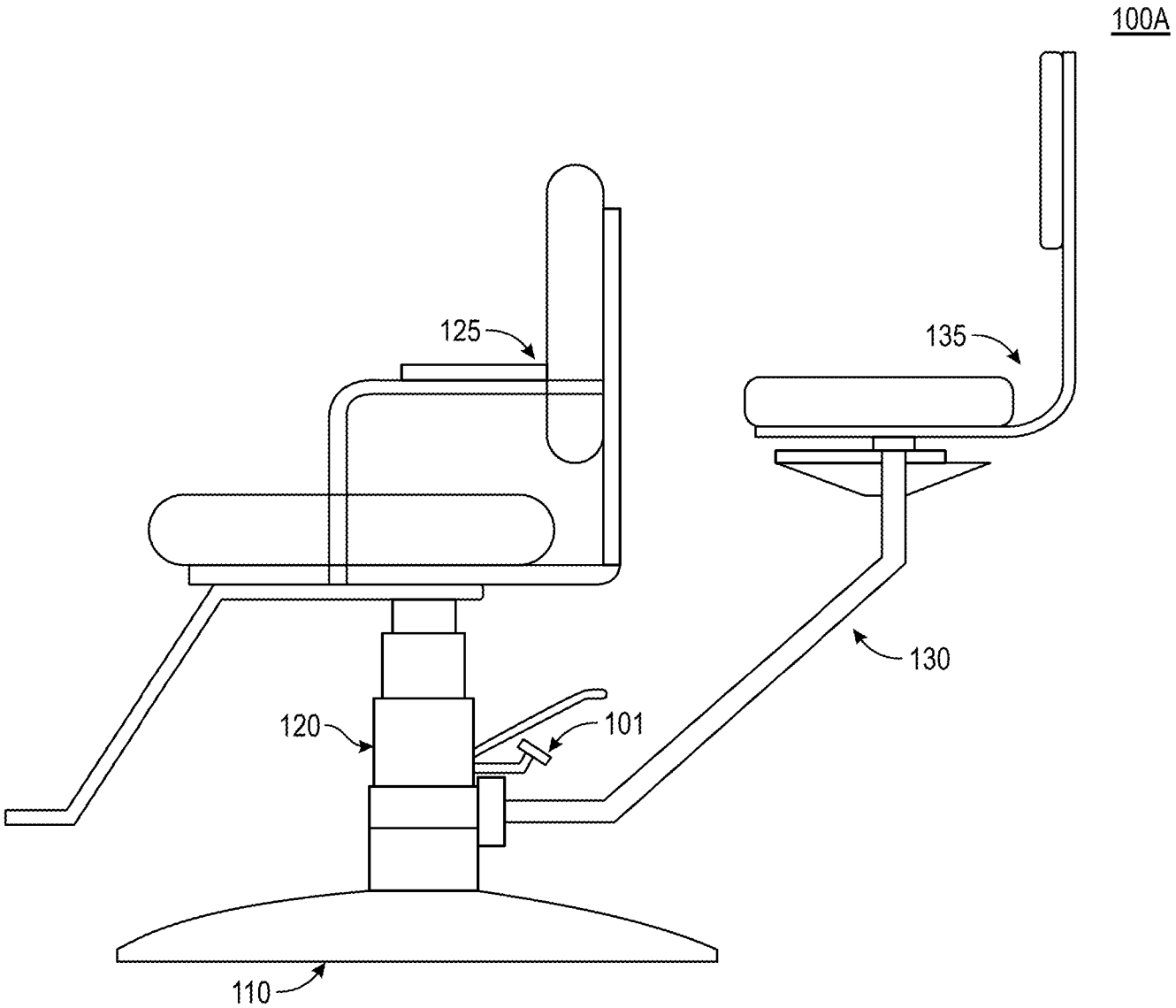
FIG. 1A is a schematic diagram illustrating a side view of a customer chair positioning system with an integrated stylist chair on a common trunk support, according to some embodiments.
Figure 1B:
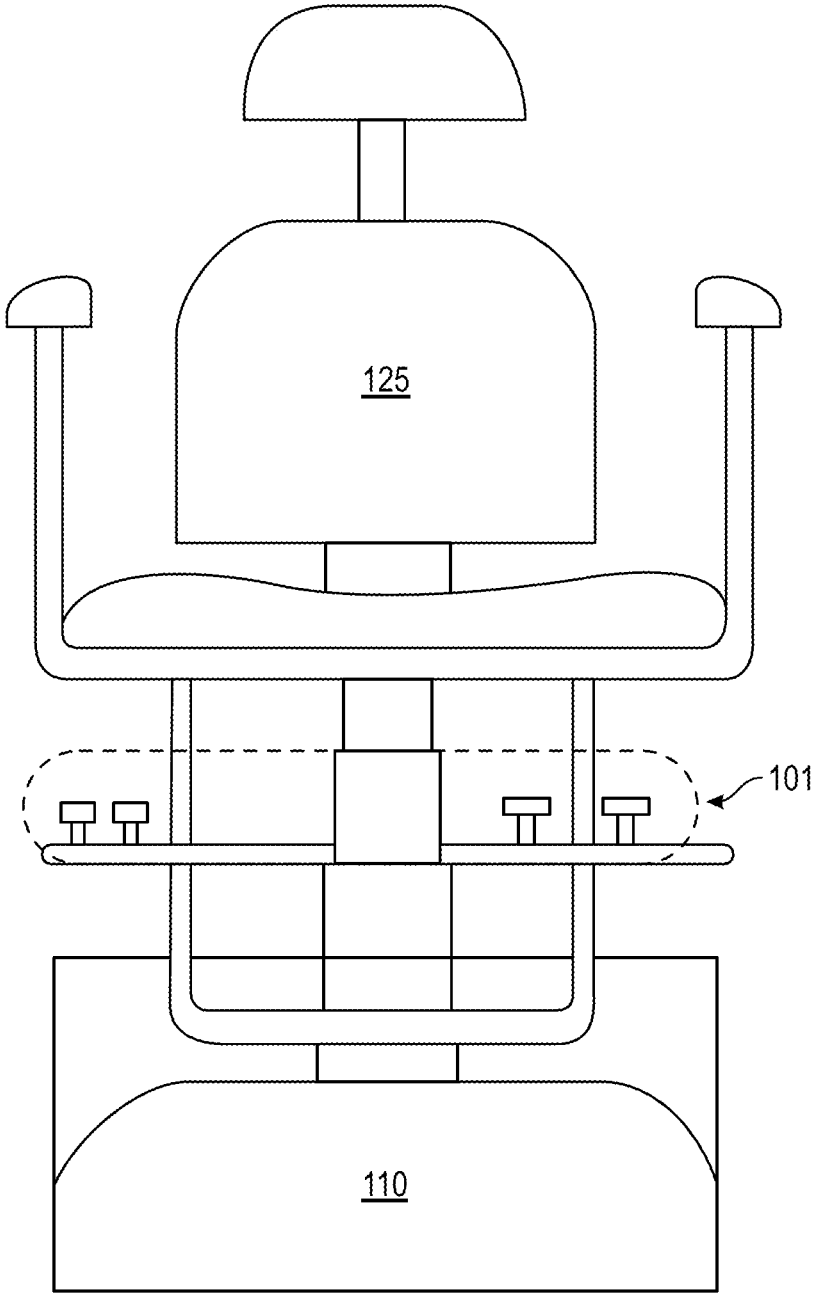
FIG. 1B is a schematic diagram illustrating a top view of the customer chair positioning system with an integrated stylist chair on a common trunk support of FIG. 1A, according to some embodiments.
Figure 2:
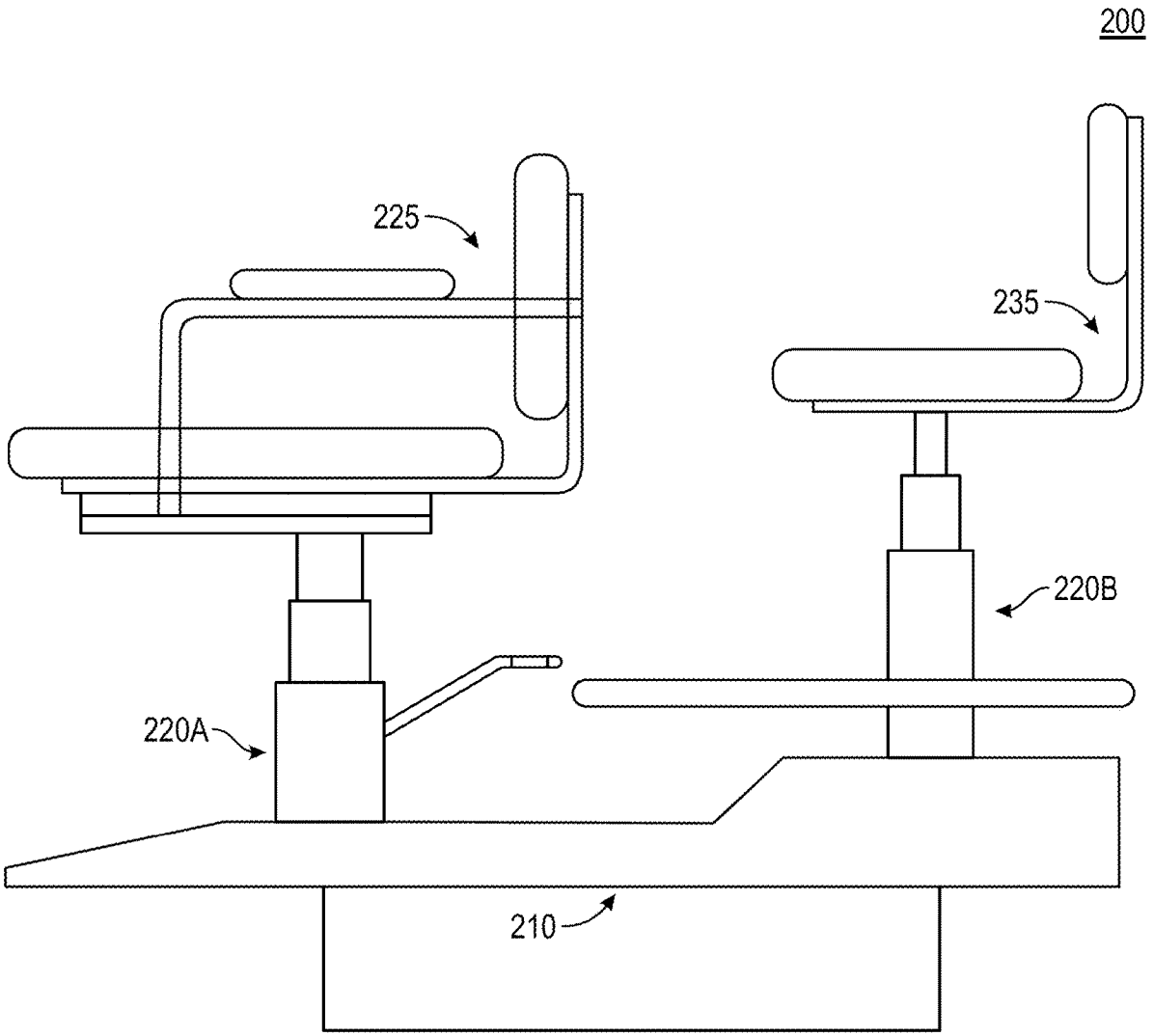
FIG. 2 is a schematic diagram illustrating a side view of a customer chair positioning system with an integrated stylist chair on a common base support, according to some alternative embodiments to FIGS. 1A-C.

FIG. 1A is a schematic diagram illustrating a side view of a customer chair positioning system 100 with an integrated stylist chair on a common trunk support, according to some embodiments. The system 100 includes a base 110, a trunk 120, a customer chair 125, a branch connected to the trunk 130, a stylist chair 135, and a foot control 101. In further detail, the base 110 supports the system 100, the trunk 120 is vertically supported by the base 110, the branch 130 is rotatably attached to and supported by the trunk 120, and the stylist chair 135 is rotatably attached to a top of the branch 130 while the customer chair 125 is rotatably attached to a top of the trunk 120. Many other variations are possible, such as the configuration of FIG. 2.

The foot control 101 allows a stylist to maneuver around a customer by moving the stylist chair 135 and/or the customer chair 125 relative to each other. In one embodiment, the both the stylist chair 135 and customer chair 125 move at a same time to one or many preset positions. In another embodiment, movement is in a series of sequential steps based on a single input of the foot control 101. Movement can be mechanically drive through pumps, actuators, and different axes of rotation. Movement can also be electrically driven through electrical signals and a processor or a microcontroller using commands stored on a flash memory element.

The foot control 101 can be attached directly to the trunk 120 or attached to the branch 130. There can be one, two or more different foot controls that are pressed downward like a gas pedal. Other embodiments of user interfaces include remote control, push buttons, levers, and the like.

In an embodiment, the trunk 120 can move vertically up and down, the branch 130 rotates around the trunk 120 over a range between 90 and 270 degrees from a center point behind the trunk 120, and the stylist chair 135 and the customer chair 125 spin over a range of 360 degrees or less and move forward and back relative to each other. Additional ranges of movement are possible including, without limitation, up and down and back and forth ranges of both the stylist chair 135 and the customer chair 125. The customer chair 125 can also recline slightly for a better angle or recline deeply to expose a beard better for shaving. Foot rests, arm rests, head rests and other components can also be adjustable.

The base 110 can have a wide and low profile to have maximum surface area supported by the floor (e.g., 36 inches in diameter). In one instance, the base 110 is bolted with anchors to a concrete floor or a wooden floor joist. In another instance, the base 110 is not coupled to the floor but is wide enough and heavy enough for support. A hole near the center of the base 110 floor area or center of gravity receives the trunk 120 when assembled or manufactured. Materials can include, without limitation, rubber, plastic, metal, and water for weight.

The trunk 120 can include an actuator or a hydraulic pump to provide lifting and lowering of the customer chair 125, responsive to a control signal or manual button. The power sources and other electrical wiring may be concealed within a hollowed chamber of the cylinder. At least a portion of the trunk 120 is reinforced and shaped for attachment of the branch 130. For example, a cylindrical shape can receive a ring on a lower end of the branch 130 and a flared platform at the same section can support the ring at a certain height. As the trunk moves up and down, so to does the flared platform causing the stylist chair 135 to follow. Some implementations move the ring portion up and down relative to the trunk 120 for height adjustment. Steel, rubber, plastic and other materials make the trunk 120 rigid.

The branch 130 can be a straight member with the ring on the bottom and the stylist chair 135 on the top. Ball bearings add rotatability around the branch 130. Other implementations use different rotation mechanisms. An angle between the trunk 120 and the branch 130 is preferably between 30 and 60 degrees to create space between the stylist chair 135 and the customer chair 125, without losing too much strength as the angle approaches 90 degrees. The angle can be fixed or adjustable.

The stylist chair 135 is a seat for a stylist of other service provider operating on a customer. During barber services, the stylist sits with legs extended near the foot control 101. One embodiment of the seat provides further support by a straight rigid member extending directly down to the base 110 and having a wheel or other mechanism to allow movement of the straight rigid member relative to the base 110. The customer chair 125 is a seat for a customer receiving services.

Figure 1C:
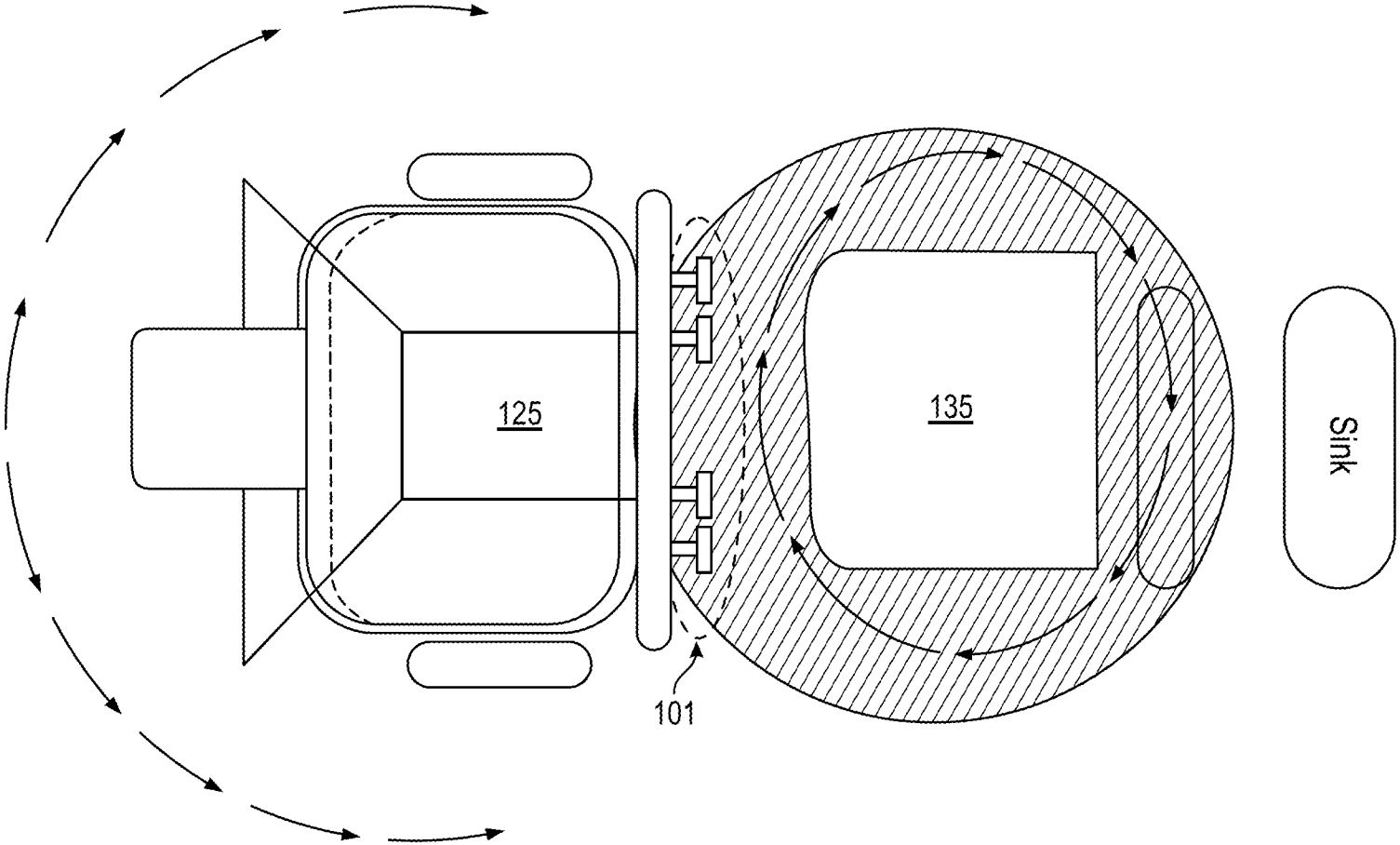
FIG. 1C is a schematic diagram illustrating a front view of the customer chair positioning system with an integrated stylist chair on a common trunk support of FIG. 1A, according to some embodiments.

Both the stylist chair 135 and the customer chair 125 can spin 360 degrees on independent axes. In one embodiment, a microcontroller decides between whether to spin or laterally move just the stylist chair 135 or whether to spin or laterally move just the customer chair 125, to reach similar relative positionings. For example, FIG. 1C shows stylist chair 135 moving from position A to position B, by spinning the branch 120 90 degrees clockwise. However, an alternative decision reaches the same relative positioning by spinning the trunk 110 90 degrees clockwise, or both by 45 degrees. Similarly, a microcontroller can automatically decide which chairs to spin. Another implementation of the foot control 101 allows a stylist to use one or more pedals for manual control movements. One embodiment uses computer vision as an input among others for making automatic decisions.

Relative positioning between chairs gives access to different sections of a customer. In one instance, a stylist can press one button to automatically change positions from a stylist being directly behind an upright customer to the stylist being on the side of a deeply reclined customer. Besides rotating 90 degrees from behind to either side, the stylist can be lowered, and the customer simultaneously raised to make up for the change in customer height from reclining. A microcontroller can automatically calculate how far the stylist chair 135 should be lowered responsive to an input of recline depth, and then automatically send a signal to a pump for movement. A branch angle may also change in some instances. In another instance, both stylist and customer are moved in tandem to remain in the same position relative to each other, but together rotate towards a mirror or away from a doorway.

FIG. 2 is a schematic diagram illustrating a side view of a customer chair positioning system 100B with an integrated stylist chair on a common base support, according to some alternative embodiments to FIG. 1.

Relative to the system 100, a stylist chair 235 shares a base 210 with a customer chair 225 rather than a common trunk as in FIG. 1. In more detail, a customer trunk 220A is vertically connected to and supported by a first part of the base 210 while a stylist trunk 210B is vertically connected to and supported by a second part of the base 210 rather than an integrated branch. Both trunks 220A,B move vertically relative to each other based on a foot pedal 201.

II. Methods for Controlling Stylist Chair Positioning (FIG. 3)

FIG. 3 is a high-level block diagram illustrating a method 300 for positioning a stylist chair relative to a customer chair in an integrated stylist and customer chair system for, according to one embodiment. The method 300 can be implemented by any of the systems 100, 200 of FIGS. 1 and 2, or other systems. One of ordinary skill in the art will recognize variability in the grouping of steps and order of execution, within the spirit of the present disclosure.

At step 310, base is attached to a floor to support the chair system. At step 320, the base is vertically stabilized with a rigid trunk member. At step 330, a rigid branch member is rotatably connected to the trunk member for support. Also, the stylist chair is rotatably connected to and supported by the branch member providing a circular range of motion for the stylist chair around and independent of the customer chair.

At step 340, a signal detected from depression of a foot pedal, and in response, both the stylist chair and the customer chairs are moved from a first relative position to a second relative position.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. The above-description will enable others skilled in the art to best utilize and practice the invention in various embodiments and with various modifications as are suited to a particular use.

I claim:

1. An integrated stylist and customer chair system for positioning a stylist chair relative to a customer chair, the chair positioning system comprising:

a base configured to attach to a floor to support the chair system; a rigid trunk member configured to vertically stabilize by the base, the rigid trunk member adjustable up and down to change; height of the customer chair, wherein the customer chair rotatably connects to and supported by the rigid trunk member; a rigid branch member that is configured to rotatably connect to the rigid trunk member for support, wherein the stylist chair is rotatably connected to and vertically supported by the rigid branch member providing a circular range of motion for the stylist chair around and independent of the customer chair; and two pedals connected to the rigid trunk member, wherein one of the pedals moves the stylist chair up and down relative to the customer chair and the other pedal rotates the stylist chair around the customer chair.

2. The chair positioning system of claim 1, further comprising: a first electrical motor coupled to the stylist chair to control positioning of the stylist chair; and a second electrical motor coupled to the customer chair to control positioning of the customerchair, wherein a controller is electrically coupled to berth tile first electrical motor and the second electrical motor.

3. The chair positioning system of claim 2, wherein: the controller is configured to toggle between a plurality of modes, one of the modes comprising a barber stylist mode, wherein the stylist chair positions a barber and the customer chair positions a customer receiving a haircut service.

4. The chair positioning system of claim 3, wherein: one of the modes of the plurality of modes comprises a makeup stylist mode having relative positioning distinct from the barber stylistmode, wherein the stylist chair positions a makeup artist and the customer chair positions a customer receiving a makeup service.

5. The chair positioning system of claim 3, wherein: one of the modes of the plurality of modes comprises a dental mode having relative postioning distinct from the barber stylist mode, wherein the stylist chair position a dentist and the customer chair positions a patient receiving a dental service.

6. The chair positioning system of claim 1, wherein: the branch member rotatably connects to the rigid trunk member to provide the circular range of at least 180 degrees for the stylist chair relative to the customer chair from a center point directly behind the stylist chair.

7. The chair positioning system of claim 1, wherein: the rigid trunk comprises a pump to power movements of the customer chair up and down.

8. The chair positioning system of claim 1, wherein: the two pedals comprises gas pedals.

9. The chair position system of claim 1, wherein the customer chair comprises a pair of armrest, a foot rest and head rest.

10. The chair positioning system of claim 1, wherein the reinforced comprises a ring and member is reinforced and shaped for attachment of the rigid branch member.

* * * * *